US011402178B2

(12) United States Patent
Batiste et al.

(10) Patent No.: US 11,402,178 B2
(45) Date of Patent: Aug. 2, 2022

(54) BALLISTIC SECURITY BARRIER SYSTEM

(71) Applicant: Buffalo Armory LLC, Buffalo, NY (US)

(72) Inventors: John Batiste, Pittsford, NY (US); Thomas Van Buskirk, Fairport, NY (US); William Portnoy, Buffalo, NY (US)

(73) Assignee: Buffalo Armory, LLC, Buffalo, NY (US)

( * ) Notice: Subject to any disclaimer, the term of this patent is extended or adjusted under 35 U.S.C. 154(b) by 64 days.

(21) Appl. No.: 16/787,862

(22) Filed: Feb. 11, 2020

(65) Prior Publication Data

US 2020/0309488 A1 Oct. 1, 2020

Related U.S. Application Data

(60) Provisional application No. 62/803,867, filed on Feb. 11, 2019.

(51) Int. Cl.
*F41H 5/24* (2006.01)
*F41H 5/013* (2006.01)
(Continued)

(52) U.S. Cl.
CPC ..... *F41H 5/24* (2013.01); *E05B 47/0046* (2013.01); *E06B 5/106* (2013.01); *F41H 5/013* (2013.01)

(58) Field of Classification Search
CPC . F41H 5/24; F41H 5/013; F41H 5/226; E06B 5/10; E06B 5/106; E05B 45/06; E05B 47/0046; B65D 65/02
See application file for complete search history.

(56) References Cited

U.S. PATENT DOCUMENTS 2,521,263 A * 9/1950 Sorenson ..... E06B 3/2605 160/60
2,604,789 A * 7/1952 Derby ..... E05B 47/0046 74/2

(Continued)

FOREIGN PATENT DOCUMENTS

| | | |
|---|---|---|
| CN | 2190152 | 2/1995 |
| CN | 201363061 | 12/2009 |
| WO | 2015035486 | 3/2015 |

OTHER PUBLICATIONS

Introducing bullet barrier / Hercules Research Corp; https://heraclesresearch.com/introducing-bullet-barrier-heracles-research-corp/; Feb. 22, 2016.

(Continued)

*Primary Examiner* — Joshua E Freeman
(74) *Attorney, Agent, or Firm* — Lorraine Hernandez; Kegler Brown Hill + Ritter Co., LPA

(57) ABSTRACT

A stand-alone, single-layer, auxiliary ballistic security barrier system configured to be installed over existing doors. The ballistic security barrier system provides protection against an active shooter with weapons, including handguns and high-powered rifles. The ballistic security barrier system includes a frame fixed to a wall with an anchor system and having structural tubing, mounting angle, and a locking system located inside the structural tubing. Further, the system includes a barrier pivotably attached to the frame and made out of material suitable to withstand impact from a high velocity rifle. The barrier is held in a first stowed position by a release apparatus, and in a second closed position by a lock.

18 Claims, 7 Drawing Sheets

(51) Int. Cl.
*E06B 5/10* (2006.01)
*E05B 47/00* (2006.01)

(56) References Cited

U.S. PATENT DOCUMENTS

| | | | | | |
|---|---|---|---|---|---|
| 3,167,621 | A * | 1/1965 | Flotron, Jr. | E05G 1/10 | 200/61.62 |
| 3,354,677 | A * | 11/1967 | Green | E05B 47/0046 | 70/279.1 |
| 3,516,470 | A * | 6/1970 | Kurz | E06B 9/0638 | 160/35 |
| 6,023,224 | A * | 2/2000 | Meyvis | E05B 47/00 | 340/545.1 |
| 6,056,037 | A * | 5/2000 | Jonkman, Sr. | E05D 15/262 | 160/118 |
| 6,308,474 | B1 * | 10/2001 | Wilson | E04G 21/30 | 150/154 |
| 6,588,705 | B1 * | 7/2003 | Frank | F42D 5/045 | 244/118.5 |
| 8,850,949 | B1 * | 10/2014 | Lopez | F41H 5/24 | 89/36.04 |
| 9,200,480 | B2 | 12/2015 | Deiler | | |
| 9,234,724 | B2 | 1/2016 | Spransy | | |
| 9,316,467 | B2 | 4/2016 | Tunis, III et al. | | |
| 10,156,428 | B2 * | 12/2018 | Fultz | E06B 3/68 | |
| 10,942,011 | B1 * | 3/2021 | Zea | E06B 9/80 | |
| 2003/0080248 | A1 * | 5/2003 | Morgan | F41H 5/0457 | 244/118.5 |
| 2003/0084616 | A1 * | 5/2003 | Kimball | E05B 9/08 | 49/504 |
| 2003/0164616 | A1 * | 9/2003 | Belmond | E05B 77/12 | 292/201 |
| 2008/0289377 | A1 * | 11/2008 | Alef | E05B 47/02 | 70/280 |
| 2009/0027197 | A1 * | 1/2009 | Frolov | E05B 45/06 | 340/542 |
| 2009/0044695 | A1 * | 2/2009 | Benjamin | F41H 5/26 | 89/36.08 |
| 2011/0048292 | A1 * | 3/2011 | Zimmer, II | F41H 5/24 | 109/64 |
| 2012/0060436 | A1 * | 3/2012 | Zimmer, II | F41H 5/22 | 52/202 |
| 2013/0212954 | A1 * | 8/2013 | Taylor | E05C 3/34 | 52/19 |
| 2014/0208993 | A1 * | 7/2014 | Spransy | E05B 65/0888 | 109/50 |
| 2015/0376923 | A1 * | 12/2015 | Presutti | E05C 19/005 | 49/506 |
| 2016/0209181 | A1 * | 7/2016 | Adrain | E06B 9/386 | |
| 2016/0230444 | A1 * | 8/2016 | Hahn | F41H 5/06 | |
| 2016/0281416 | A1 * | 9/2016 | Spransy | E05C 19/00 | |
| 2016/0376821 | A1 * | 12/2016 | Ward | E06B 7/22 | 49/394 |
| 2017/0191306 | A1 * | 7/2017 | Falesch | E06B 5/10 | |
| 2018/0080272 | A1 * | 3/2018 | Fujishin | E06B 1/18 | |
| 2019/0113312 | A1 * | 4/2019 | Adrain | B60J 1/2088 | |
| 2020/0018572 | A1 * | 1/2020 | Gonzales | E06B 3/481 | |
| 2020/0072580 | A1 * | 3/2020 | Deering | F41H 5/0457 | |
| 2020/0232271 | A1 * | 7/2020 | Ramachandran | E06B 5/11 | |
| 2020/0232767 | A1 * | 7/2020 | Riden | F41H 5/013 | |
| 2020/0248990 | A1 * | 8/2020 | Larson | F41H 5/06 | |
| 2020/0347643 | A1 * | 11/2020 | Burke | E05B 45/06 | |

OTHER PUBLICATIONS

Bullet Shield Ballistic Panel; https://www.windowfilmdepot.com/product/bulletshield/.

Ballistic Restraint Products; https://www.windowgard-security.com/ballistic.

Blast Structures World's Highest Rated Blast and Bullet Resistant Structures; https://www.blaststructures.com/bullet-resistant-products/.

Ballistic Protection Group Bullet and Blast Resistant Products and Installation; http://ballisticprotectiongroup.com/products.htm.

Triad Security Systems Bullet Resistant Door Guard; https://triadsecuritysolutions.com/collections/doors.

* cited by examiner

BALLISTIC SECURITY BARRIER SYSTEM

This non-provisional claims priority to U.S. Provisional Application No. 62/803,867, filed on Feb. 11, 2019, herein incorporated in its entirety by reference.

FIELD

The present invention relates generally to security barriers for entryways. In particular, the present invention relates to an auxiliary ballistic security barrier to deter entry into secured areas by unauthorized personnel.

BACKGROUND

In recent years, shooting incidents at schools and other public gathering places has unfortunately become more prevalent. These incidents often involve one or more intruders entering a school or office building with a firearm or other weapon. Accordingly, there is a need to be able to rapidly secure entryways of such facilities or portions thereof against intrusion. Various methods have been suggested that require modifications to existing building or door structures. Such modifications are typically costly and labor-intensive, and thus are often beyond the budgets of the managers of such facilities. Furthermore, the physical arrangement of many buildings, particularly older structures, do not lend themselves well to the modifications necessary to add security barriers.

Fire safety requirements are of particular concern for devices that are designed to prevent the unauthorized opening of an entryway used in public buildings such as schools. In order to be compliant with many such standards, an occupant of a locked room must be able to exit the room with a single motion in the event of a fire, for example, by moving a door handle to an unlocked position.

Accordingly, there is a need for a way to quickly and effectively secure an entryway against intruders that can easily be added to an existing door without modification of the door or building structure. Such a system should not require additional components to be added to an existing door, and must allow for operation of a standard door of the entryway during normal use of the building. There is a further need for a way to secure an entryway that complies with applicable fire code requirements and does not otherwise compromise the safety of the occupants of a room when secured against intruders by the barrier.

SUMMARY

A ballistic security barrier system is disclosed according to an embodiment of the present invention. The present invention comprises a stand-alone, single-layer, auxiliary barrier system that may be installed at a doorway in any structure including, without limitation, a classroom, office, community center rooms, or place of worship, whether existing or new construction. The present invention is completely independent of the building structure, being attached to a wall rather than a door. The barrier is configured to be installed over existing doors, including at space-restricted locations, over both in-swinging and out-swinging doors. When threatened, a teacher or other authorized person may simply release and close the barrier in a single motion to create a secure "safe room" for students or other occupants, providing protection against an active shooter with weapons, including handguns and high-powered rifles. In some embodiments of the present invention, the barrier may be selectably secured with a magnetic lock or with suitable mechanical and/or electrical technology, and can be configured to be safely opened from both within a secured classroom/office side or an exterior or hallway side of the entryway.

In some embodiments of the invention, the barrier system may be constructed with structural steel, ballistic armor of a suitable thickness, high-strength hinges, and a magnetic or mechanical/electric locking system. Preferably, the barrier is constructed using a single layer of material, with optional stiffeners to ensure sufficient rigidity and provide a generally planar surface to fit against a facially adjacent frame.

A frame of the barrier system may include structural tubing and angle, which can include ballistic armor for protection against compromise by intruders. Electromagnets, electrical-mechanical locking mechanisms, wiring and the like may be concealed inside the structural tubing, which may also include protective ballistic armor if desired. Depending upon the building's construction design, the barrier frame may be fixed to the building wall with suitable mechanical or chemical anchor systems.

The barrier system is mounted far enough back from the wall to prevent interference with the existing door or its door handle. This is accomplished by selecting the depth of the framework to fit a particular installation.

In a preferred embodiment of the invention, the ballistic armor barrier system is constructed with a single-layer induction armor or conventional armor certified to Standard NIJ 0108.01 Level 3 promulgated by the National Institute of Justice. This standard defines armor requirements to provide protection against high velocity rifles and all lesser weapons.

The barrier system is preferably mounted to the structural tubing with heavy-duty hinges. The hinges are preferably welded or bolted to the armor barrier and structural tubing. A high-holding force magnetic lock is installed inside of a strike jamb tubing, generally flush to a contacting surface. The electromagnets and jamb may be mounted in place with recessed brackets using common anchors. Magnetic lock adjustable armature plates are recessed into the armor barrier system.

When not in use, an armored barrier of the system is held open to the classroom or office wall with a magnetic or mechanical stop. If a magnetic stop is utilized, a magnet of the stop is energized when the barrier is on stand-by in a stowed position, preventing unintended closure of the barrier.

Lockdown is initiated by lifting a protective cover and pushing an activation switch, plunger, lever, or other suitable actuation release device, which de-energizes the magnet holding the barrier in the stowed open position and immediately energizes lockdown magnets to lock the barrier when swung to the closed position to complete the lockdown. By activating the actuation device, the barrier is released from the open position, allowing it to swing to a closed position and activating the magnetic lock system. When armature plates of the barrier make contact with the magnetic locks, the barrier is held securely. In an alternate embodiment of the present invention, a mechanical-electrical lock system may be used. In this embodiment, the electromagnets are not required and the barrier is swung into the closed position and locked with suitable electrical and/or mechanical devices.

To open the barrier from inside the secured classroom or office side, a "Push to Exit" button or actuator may be pressed to de-energize the magnetic lock, thereby breaking the electrical circuit to open the barrier. In turn, the door stop magnet is re-energized (if a magnetic stop is used), to secure the barrier in its stowed position. Alternatively, a mechanical lever may be actuated to release the barrier if a magnetic stop is not utilized.

In various embodiments of the present invention, secure unlocking devices including, but not limited to, a code-protected keypad, a wireless activated device, and an electronic "FOB" such as a radio frequency or other type of transmitter may be provided for unlocking and releasing the barrier from outside the secured classroom or office.

BRIEF DESCRIPTION OF THE DRAWINGS

Further features of the present invention will become apparent to those skilled in the art to which the present invention relates from reading the following specification with reference to the accompanying drawings, in which.

DETAILED DESCRIPTION

Figure 1:
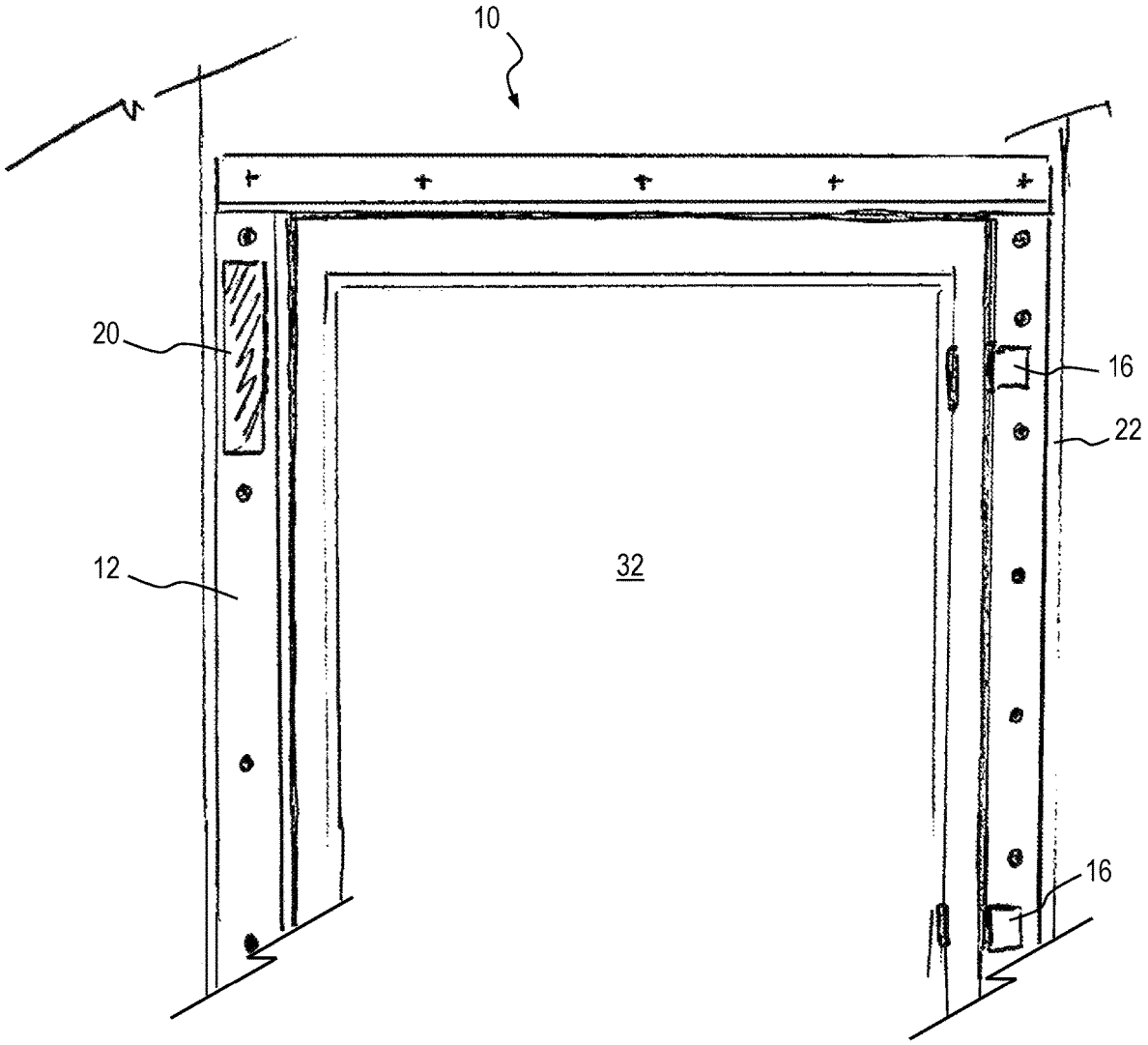
FIG. 1 is a partial front elevational view of a ballistic security barrier system according to an embodiment of the present invention, shown with a barrier removed for clarity.

In the discussion that follows, like reference numerals are used to indicate like or similar elements and structures.

Figure 2:
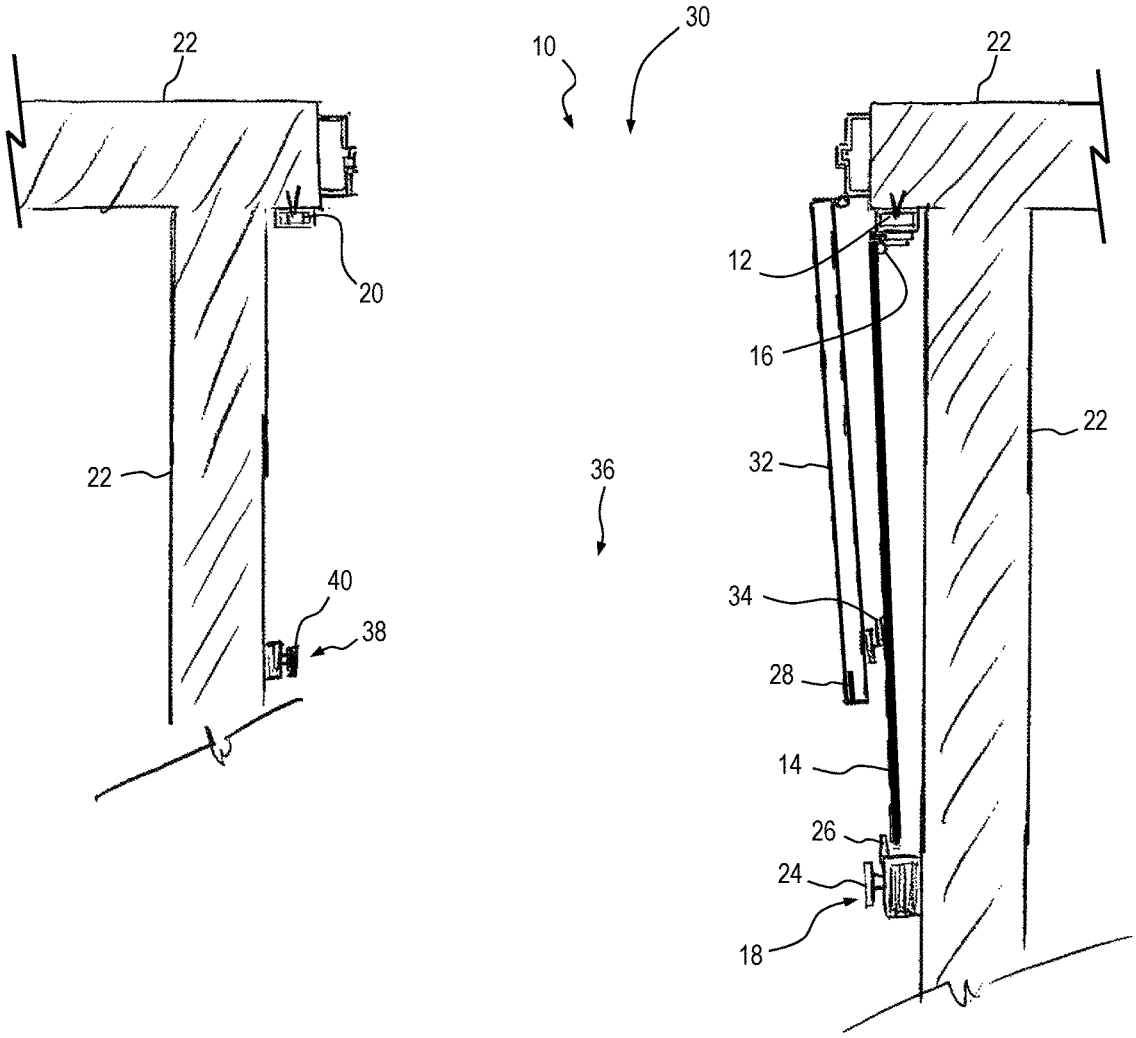
FIG. 2 is a top plan view of the ballistic security barrier system of FIG. 1 in a first, open position.
Figure 3:
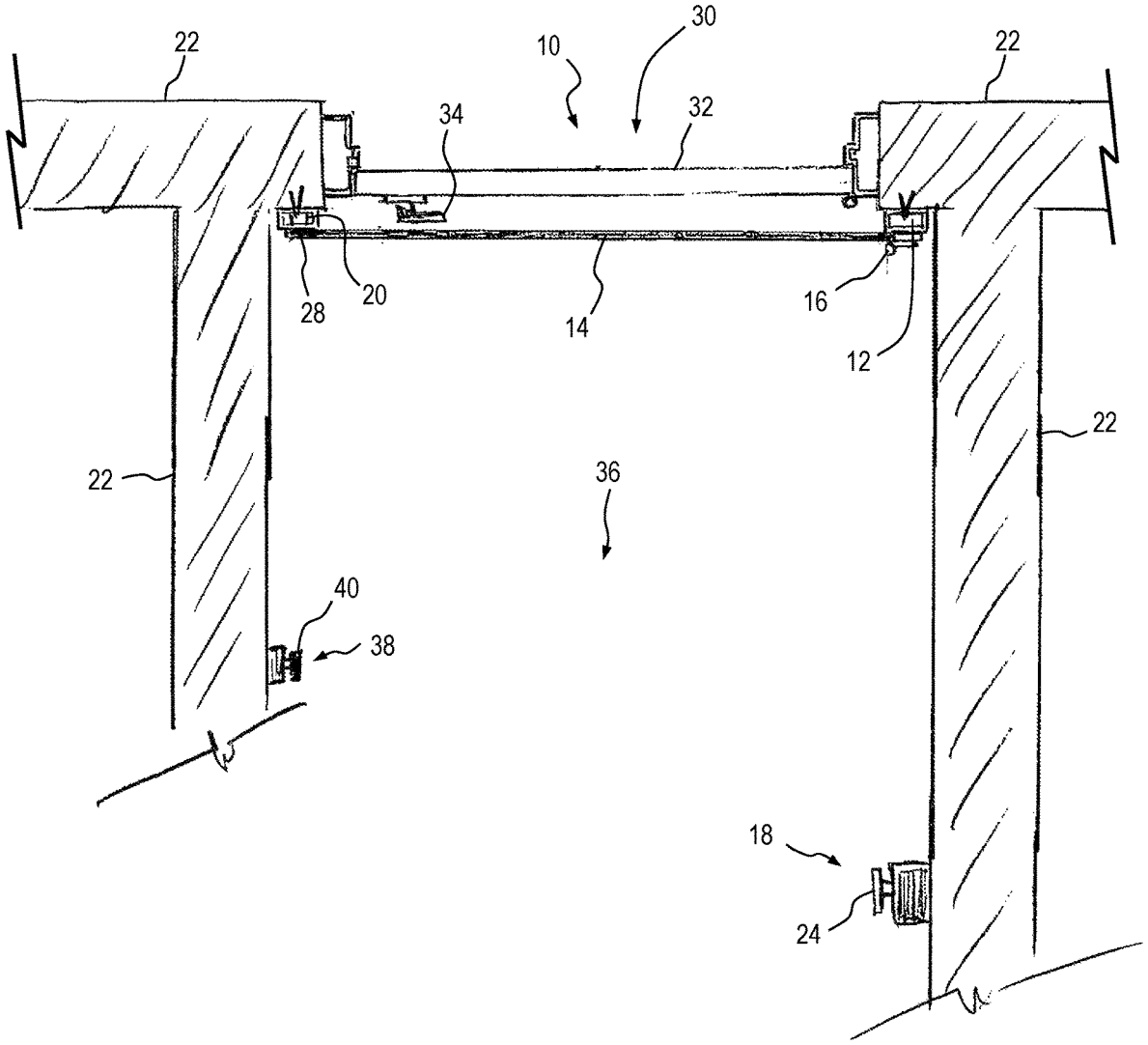
FIG. 3 is a top plan view of the ballistic security barrier system of FIG. 1 in a second, closed position.

The general arrangement of a ballistic security barrier system 10 is shown in FIGS. 1, 2 and 3 according to an embodiment of the present invention. System 10 comprises a frame 12. A barrier 14 is preferably pivotably attached to frame 12 with one or more hinges 16. Barrier 14 is held in a first, stowed position as shown in FIG. 2 by a release apparatus 18. Barrier 14 is held in a second, closed position as shown in FIG. 3 by a magnetic lock 20.

Frame 12 is preferably constructed with structural tubing and angle, which may be protected against damage by intruders with ballistic armor if desired. Electromagnets, a mechanical locking mechanism wiring and so on may be concealed inside the structural tubing, which can also be protected with ballistic armor if desired. Frame 12 may be fixed to a building wall 22 with suitable mechanical or chemical anchor systems, depending upon the building's construction design.

Barrier 14 may be constructed with any suitable materials to withstand attack by high velocity rifles and all lesser weapons. In some embodiments, a single layer of induction armor or conventional armor certified to Standard NIJ 0108.01 Level 3 may be utilized. This standard defines armor requirements to provide protection against high velocity rifles and all lesser weapons.

Hinges 16 are preferably heavy-duty type hinges. Hinges 16 may be welded or bolted to frame 12 and barrier 14 to pivotally attach the barrier to the frame.

Release apparatus 18 comprises an activation switch 24, button, plunger, lever or the like which operates a selectably actuated stop 26 that is sized, shaped and positioned to hold barrier 14 in an open position (FIG. 2). Release apparatus 18 may be mounted or attached to wall 22. Release apparatus 18 may also be a magnetic lock similar to magnetic lock 20 or other suitable magnetic, mechanical, or electric devices, detailed further below. If magnetic, switch 24 functions to disconnect electrical power from an electromagnet of release apparatus 18, allowing barrier 14 to be swung away from the release apparatus. A protective cover (not shown) or other device may be utilized over the activation switch 24 to deter accidental operation of release apparatus 18.

With continued reference to FIGS. 2 and 3, the general arrangement of a magnetic-electric control sub-system 62 (FIG. 6) comprises one or more high-holding force electromagnetic locks or a magnetic lock installed inside of a strike jamb of frame 12, generally flush to a contacting surface of barrier 14. The electromagnets and jamb may be mounted in place with recessed brackets using common anchors. Magnetic lock adjustable armature plates 28 are preferably recessed into the armored barrier 14. Magnetic lock 20 preferably includes a power supply, a control box, and a back-up battery, detailed further below. Should AC mains electrical power be lost, the battery back-up will provide magnetic/electrical locking security.

With reference now to FIG. 2, barrier 14 is held in a first, stowed open position by stop 26 (or an electromagnet) of release apparatus 18, providing for normal use of an entryway 30. In the stowed position of barrier 14, a standard residential, office or industrial type entry door 32 may be opened or latched in a closed position with a door handle 34.

With reference now to FIG. 3, in the event of an attack a lockdown of a room or area 36 accessed by entryway 30 may be initiated by closing standard door 32, then operating release apparatus 18 to allow barrier 14 to be pivotably moved from the stowed position to the closed position. In the magnetic-electric embodiment of system 10, operation of release apparatus 18 also electrically energizes magnetic lock 20, causing armature plates 28 of barrier 14 to engage the magnetic lock and securely retain the barrier in the closed position.

In the magnetic-electric embodiment of system 10, once the threat has been neutralized, barrier 14 may be opened from inside the secured area or room with an exit device 38. A switch 40 button, plunger, lever or the like of exit device 38, when actuated, de-energizes magnetic lock 20, thereby allowing barrier 14 to be moved away from frame 12. Barrier 14 is pivotally moved to the stowed position and held in place by stop 26 of release apparatus 18 or an electromagnet of the release apparatus, which may be energized by the operation of exit device 38 when magnetic lock 20 is de-energized.

Barrier 14 may alternatively be opened by de-energizing magnetic lock 20 with a suitably secure device operated from outside the secured area or room such as, for example, an electrical key switch, a keypad-controlled actuator attached to wall 22 or a FOB such as a radio frequency or other type of transmitter. Further details of example devices are provided below.

Figure 4:
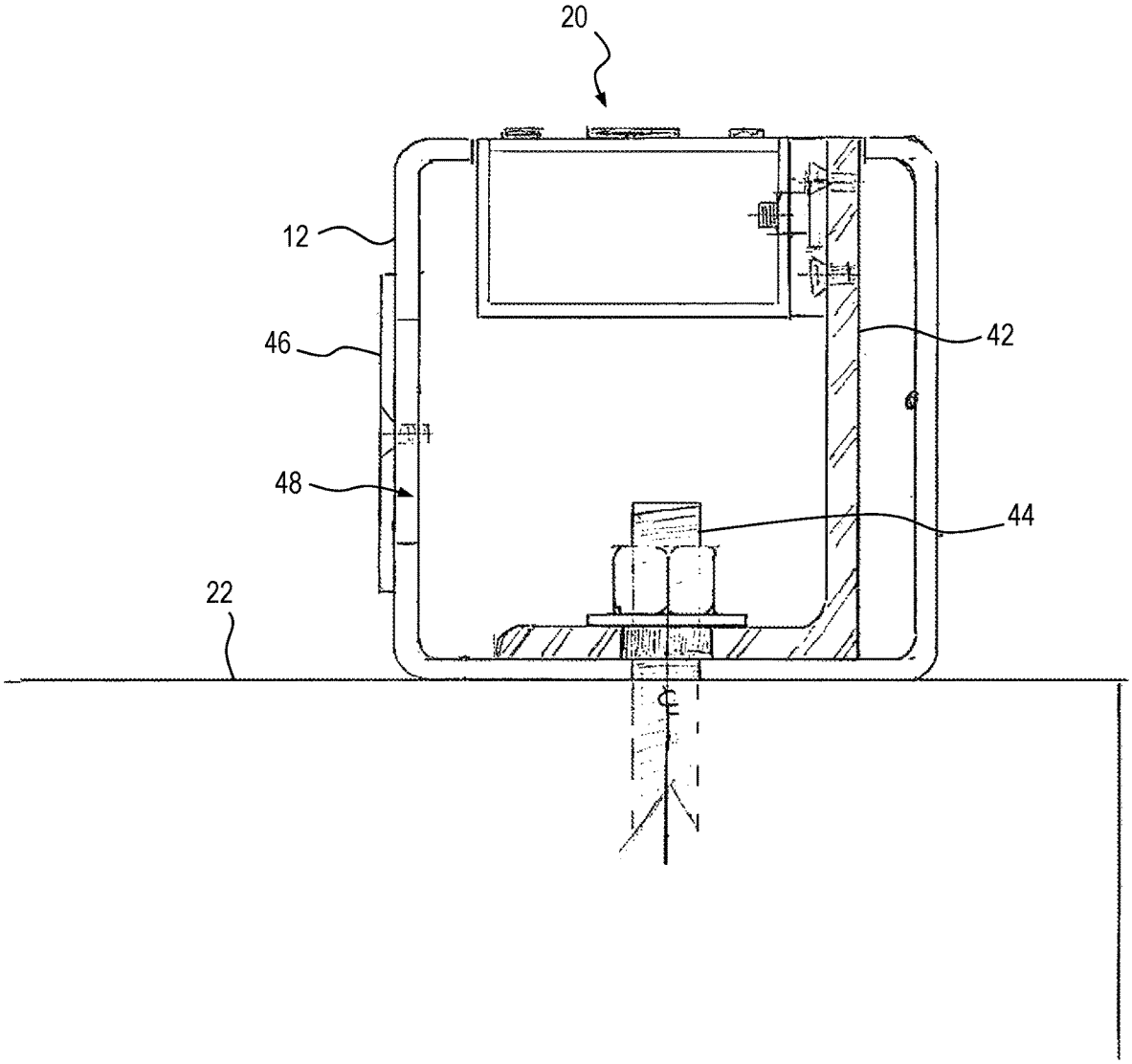
FIG. 4 is a view in section showing details of a magnetic lock of the ballistic security barrier system of FIG. 1 according to an embodiment of the present invention.

Details of an example magnetic lock 20 are shown in FIG. 4 according to an embodiment of the present invention. Magnetic lock 20 is attached to a mounting angle 42, which is in turn attached to frame 12. Frame 12 is attached to a wall 22 with one or more studs 44. A selectably detachable cover 46 may be used to close off an opening 48 of frame 12 once installation of magnetic lock 20 and studs 44 is complete.

Figure 5:
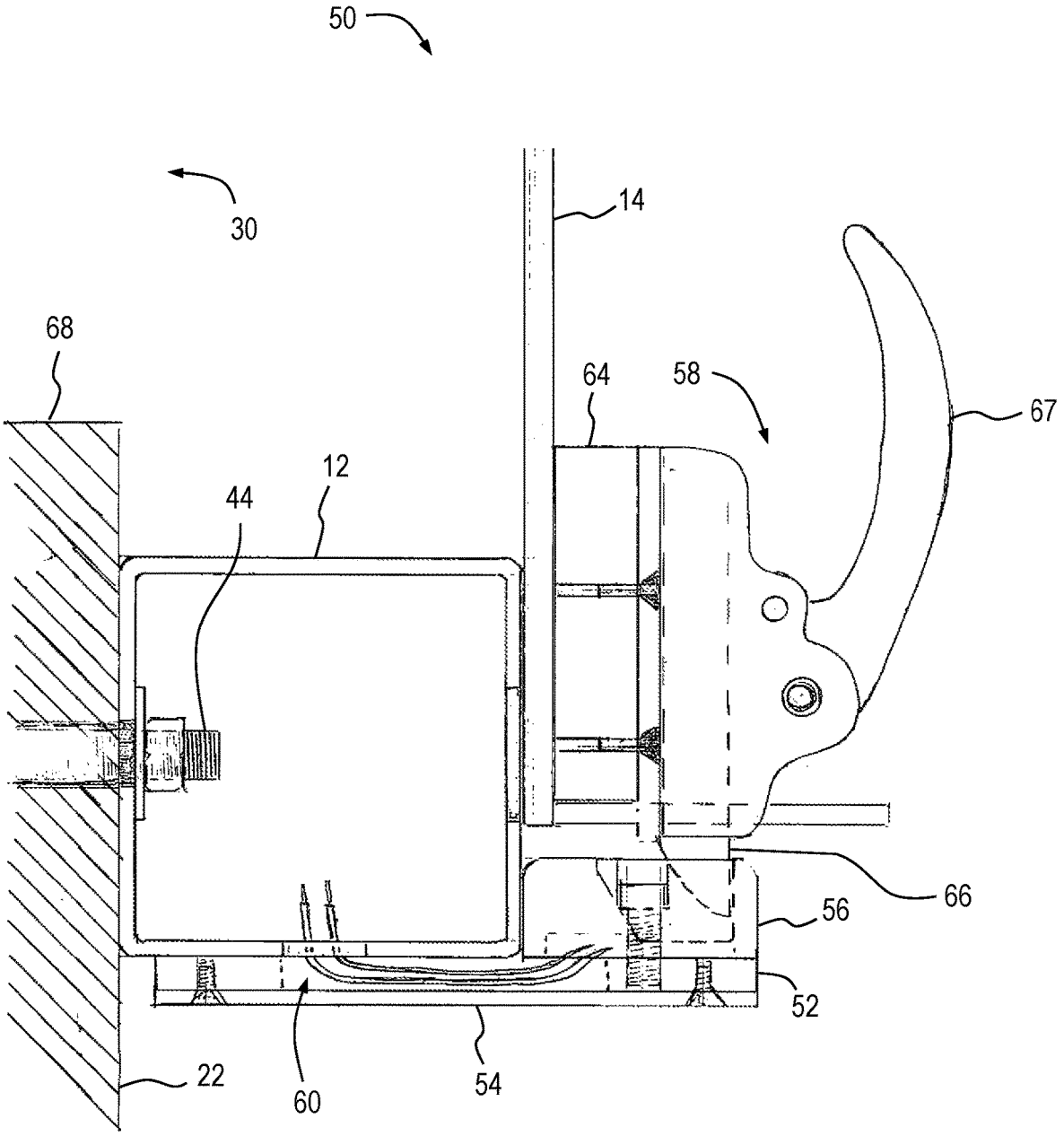
FIG. 5 is a view in section showing details of a release apparatus of the ballistic security barrier system of FIG. 1 according to an embodiment of the present invention.

Details of an example mechanical-electrical lock and exit device 50 are shown in FIG. 5 as an alternative to exit device 38 where an electromagnetic lock 20 is replaced by a mechanical-electrical lock. Frame 12 is attached to a wall 22 with one or more studs 44. A strike support plate 52 and a cover plate 54 are attached to frame 12 and an electric strike 56 is attached to the strike support plate. The electric strike 52 and a mechanical pull to release latch 58 eliminate the need for the recessed electromagnet 20, the recessed armature plate 28 and the exit device 38, 40. Wiring 60 of electric strike 56 is coupled to a control subsystem 78, shown in FIG. 7 and detailed below. A latch mounting plate 64 is attached to barrier 14 and a latch 58 is attached the latch mounting plate such that a latchbolt 66 of the latch engages electric strike 56, allowing barrier 14 to be selectably moved from its closed position (FIG. 3) to its open position (FIG. 2). An inside edge 68 of an entryway 30 in wall 22 is shown for general reference.

To close and lock the mechanical-electric type lock and exit device 50 (FIG. 5), barrier 14 is pushed to its closed position, engaging the latchbolt 66 to the electric strike. To open the barrier 14 from inside the room 36, a pull handle 67 of latch 58 is pulled, which releases the latch and the barrier. To open barrier 14 from outside the room, electric strike 56 is actuated by controller 70 in response to an external control signal, such as a keypad, allowing latchbolt 66 to move away from the electric strike.

Controller 70 may comprise any suitable combination of control elements including, without limitation, analog controls, digital controls, predetermined instructions such as software and firmware, ladder-logic controls, and relays.

Figure 6:
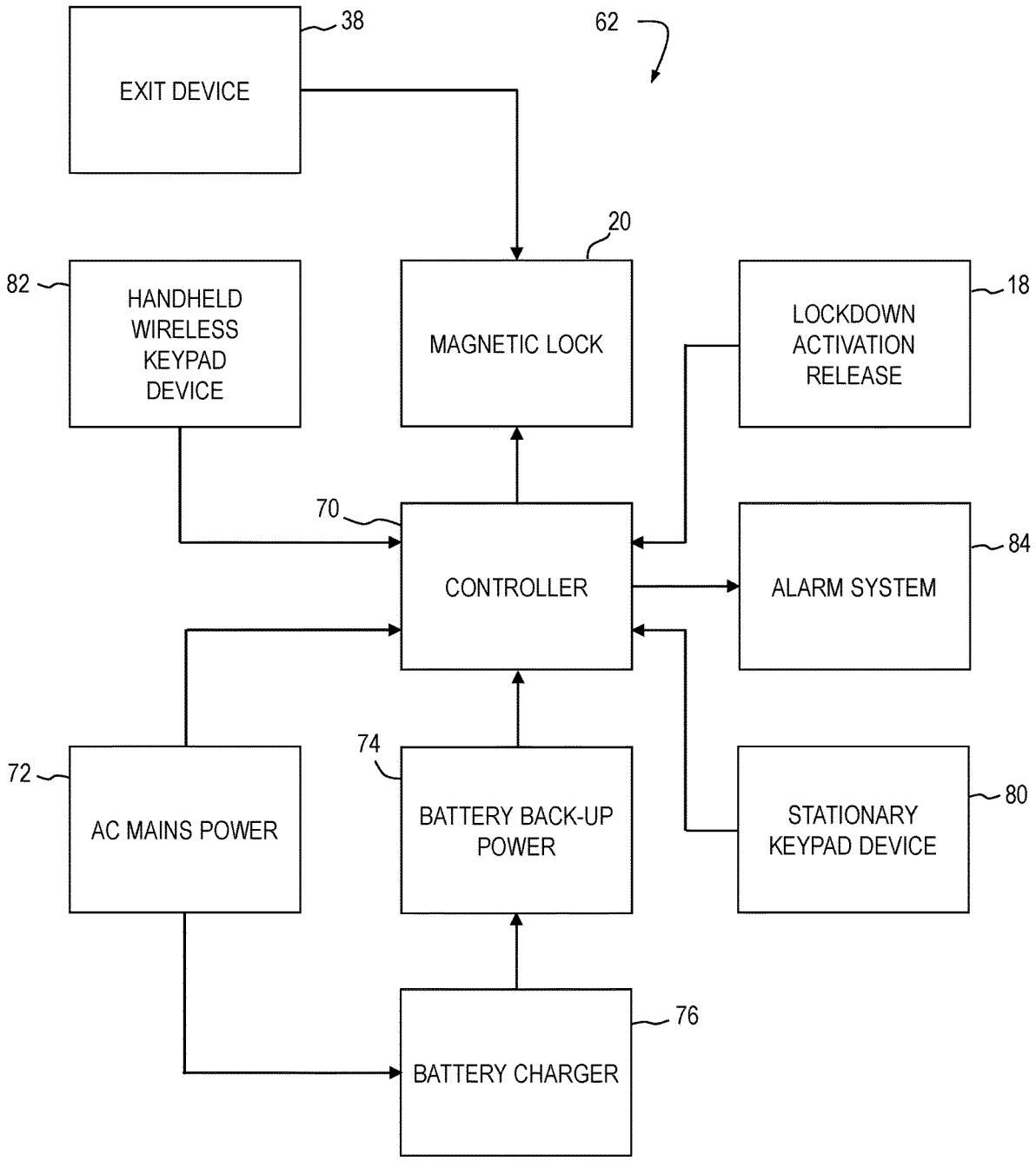
FIG. 6 is a schematic block diagram of a controller subsystem according to an embodiment of the present invention.

With reference now to FIGS. 2, 3 and 6, in operation of control subsystem 62, magnetic lock 20 is de-energized in its stowed stand-by condition (FIG. 2). A stop 26 or an energized magnet of release apparatus 18 holds barrier 14 in the stowed position. Upon receiving an actuation signal input from release apparatus 18 by actuation of switch 40, stop 26 is moved to a position clear of barrier 14 or a magnet of the release apparatus is de-energized. Magnetic lock 20 is energized and engages barrier 14 when the barrier is moved facially adjacent to and in contact with frame 12. Magnetic lock 14 securely holds barrier 14 against frame 12 as shown in FIG. 3, deterring entry into a protected classroom, office, etc. by intruders.

When barrier 14 is to be returned to its stowed condition (FIG. 2), switch 40 of exit device 38 is actuated. Controller 70, upon receiving a signal from exit switch 40, de-energizes magnetic lock 20, allowing barrier 14 to be moved away from frame 12 to its stowed position. Barrier 14 is then again held in place by stop 26 or a re-energized magnet of release apparatus 18 to secure the barrier in its stowed position.

With further reference to FIG. 6, a controller 70 is powered primarily by AC mains power 72. In the event of a failure of AC mains power 72, a backup battery power supply 74 is maintained at a relatively full charge by a battery charger 76.

Figure 7:
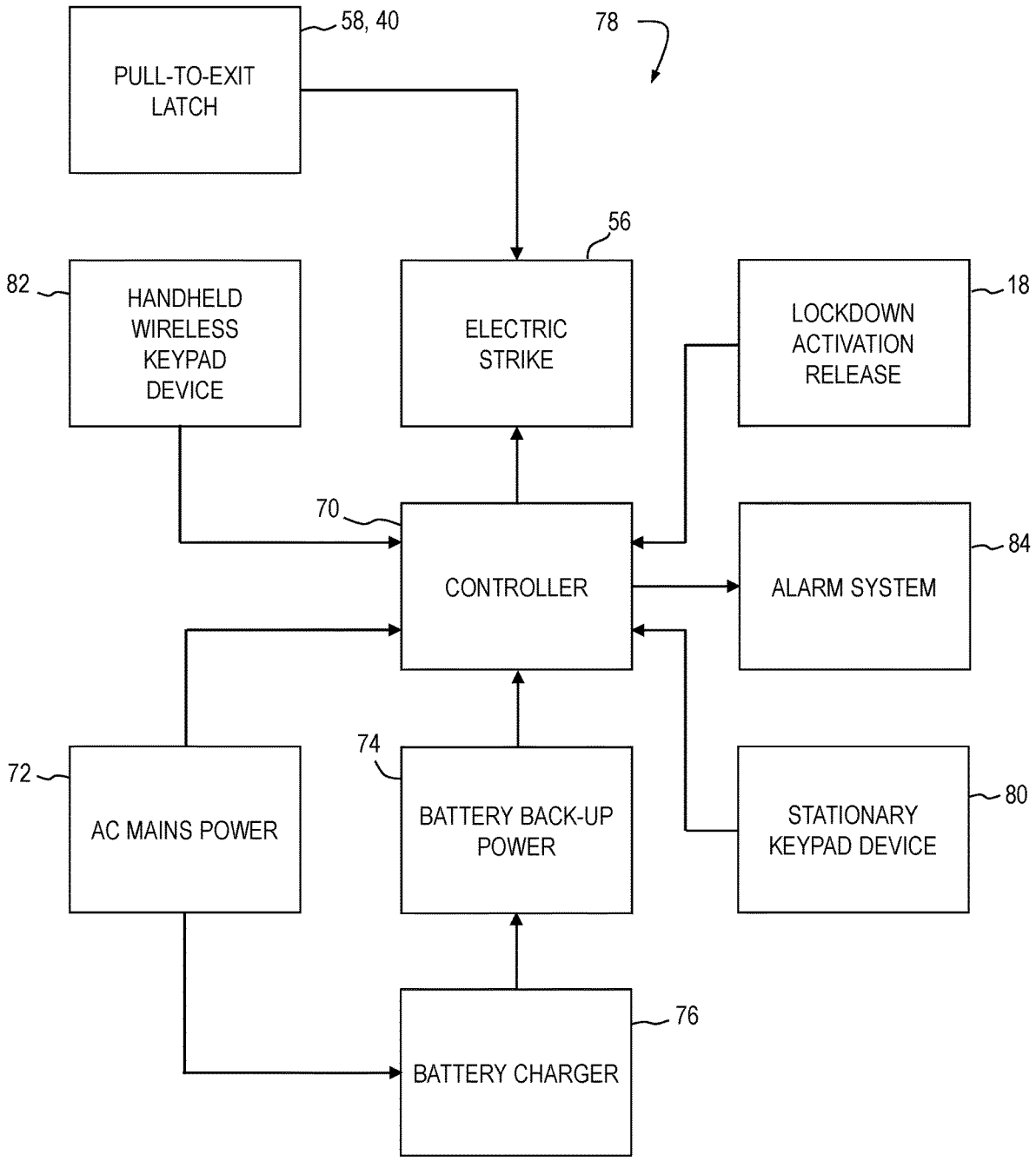
FIG. 7 is a block diagram of a controller subsystem according to another embodiment of the present invention.

The general arrangement of a mechanical-electric control sub-system 78 is shown in FIG. 7 according to an alternate embodiment of the present invention that does not require the use of magnetic lock 20. A controller 70 is powered primarily by AC mains power 72. In the event of a failure of AC mains power 72, a backup battery power supply 74 is maintained at a relatively full charge by a battery charger 76. Electric strike 56 and pull-to-exit latch 58 are used in place of magnetic lock 20 to selectably hold barrier 14 in the closed position of FIG. 3.

In some embodiments of the present invention, frame 12 and barrier 14 may be finished in a manner selected by the customer such as, without limitation, painting or powder coating in a select color. In addition, barrier 14 may include a mural affixed thereto such as a vinyl adhesive mural having a range of artistic options.

In some embodiments of the present invention barrier 14, when in the open position (FIG. 2), may be utilized as a magnetic bulletin board. Likewise, a whiteboard or chalkboard may be affixed to barrier 14.

The ballistic security barrier systems described herein may also be opened from outside a secured room or area with a stationary keypad 80. Stationary keypad 80 may be electrically wired to controller 70 or may be wirelessly linked to the controller in a manner similar to a portable keypad 82, described below. The stationary keypad 80 may be strategically located outside the secured area or room, such as in a hallway, or may be remotely located, such as in a supervisory or security office. Stationary keypad 80 may also be configured to be easily moved or relocated if desired. If an intruder attempts to utilize stationary keypad 80, the stationary keypad can be configured to disable if incorrect security codes are entered or if the stationary keypad is damaged.

Similarly, a portable keypad 82 may be utilized. Portable keypad 82 may include a transmitter configured to wirelessly transmit a coded signal to a corresponding receiver of controller 70. In some embodiments of the present invention portable keypad 82 is a handheld or "FOB" device. If an intruder attempts to utilize portable keypad 82, the portable keypad can be configured to disable if incorrect security codes are entered or if the portable keypad is damaged.

Keypads 80, 82 may be configured to be programmed with an individual code to open barrier 14. Alternatively, keypads 80, 82 may be programmed with "universal" or "zone" codes to open a predetermined group of barriers 14 or all barriers. As a non-limiting example, a room numbered 120 may be programmed for opening of its barrier 14 with an access code of Q120 #, a room numbered 121 may be programmed for opening of its barrier with an access code of Q121 #, and a room numbered 122 may be programmed for opening of its barrier with an access code of Q122 #.

In some optional embodiments, a standalone or central alarm 84 (FIGS. 6 and 7) may be coupled to system 10 and configured to sound aural and/or visual alerts in the event system 10 is deployed. Such alarms 84 may further include a remote alarm, such as issuing an alarm condition signal to a remote monitoring station, 911 Emergency personnel, and other first responders. The alarm 84 may further be configured to issue a warning by means of a public address (PA) system, such as a school PA system. In addition to issuing an alarm warning for help, the alarm 84 may be utilized to alert all occupants of a building to move immediately to designated safe rooms for lockdown.

In a further optional embodiment, each classroom or office may include an intercom system (not shown) for outside communication.

As can be seen from the foregoing description, system 10 meets fire safety requirements whereby an occupant of a locked room must be able to exit the room with a single action in the event of a fire, for example, by moving a door handle to an unlocked position. In addition, the present invention is an auxiliary arrangement that can be installed to a wide variety of entryways without modification of building structures. Furthermore, while the present invention is described herein in the context of schools and office buildings, it should be noted that this is for illustrative purposes only and is not intended to be limiting in any way. As can be appreciated, the present invention may be utilized in conjunction with any entryway.

From the above description of the invention, those skilled in the art will perceive improvements, changes, and modifications in the invention. Such improvements, changes, and modifications within the skill of the art are intended to be covered.

What is claimed:

1. A ballistic security barrier system comprising:

a frame, said frame fixed to a wall with an anchor system, the frame comprising of structural tubing, mounting angle, and a locking system located inside the structural tubing;

a barrier, said barrier pivotably attached to the frame with at least one hinge, the barrier made out of material suitable to withstand impact from a high velocity rifle, wherein the barrier is held in a first stowed position by a release apparatus, and wherein the barrier is held in a second closed position by a lock.

2. The ballistic security barrier system as claimed in claim 1 wherein the locking system comprises a high-holding force electromagnet, and the barrier comprises adjustable armature plates.

3. The ballistic security barrier system as claimed in claim 2 wherein the lock is a magnetic lock between the high-holding force electromagnet in the frame and the adjustable armature plates of the barrier.

4. The ballistic security barrier system as claimed in claim 3 wherein the magnetic lock further comprises a power supply, control box, and a back-up battery.

5. The ballistic security barrier system as claimed in claim 3 further comprising an exit device, said exit device comprising a switch button adapted to de-energizing the electromagnet.

6. The ballistic security barrier system as claimed in claim 2 wherein the release apparatus comprises an activation switch and a magnet stop, the magnet stop comprises a magnet and the activation switch is adapted to operate the magnetic stop by energizing the magnet to hold the barrier in the first stowed position and by de-energizing the magnet to release the barrier from the first stowed position.

7. The ballistic security barrier system as claimed in claim 6 wherein the lock is a magnetic lock between the high-holding force electromagnet in the frame and the adjustable armature plates of the barrier and the activation switch of the release apparatus is adapted to energize the electromagnet in the frame.

8. The ballistic security barrier system as claimed in claim 6 wherein the activation switch further comprises a controller.

9. The ballistic security barrier system as claimed in claim 1 wherein the frame further comprises ballistic armor.

10. The ballistic security barrier system as claimed in claim 1 wherein the material suitable to withstand impact from a high velocity rifle comprises a single layer of armor certified to Standard NIJ 0108.01 Level 3.

11. The ballistic security barrier system as claimed in claim 1 wherein the release apparatus comprises an activation apparatus adapted to operate an actuated stop positioned to hold the barrier in the first stowed position.

12. The ballistic security barrier system as claimed in claim 1 wherein the lock is a mechanical-electrical lock.

13. The ballistic security barrier system as claimed in claim 12 further comprising:

a strike support plate;

a cover plate;

an electric strike;

a latch mounting plate; and a latch, wherein the strike support plate and the cover plate are attached to the frame, wherein the latch is attached to the latch mounting plate, and the latch mounting plate is attached to the barrier.

14. The ballistic security barrier system as claimed in claim 13 wherein the latch further comprises a latchbolt, the latchbolt adapted to engage the electric strike to hold the barrier in the second closed position.

15. The ballistic security barrier system as claimed in claim 14 wherein the latch further comprises a pull handle adapted to release the barrier and latch.

16. The ballistic security barrier system as claimed in claim 14 further comprising a controller adapted to release the latchbolt from the electric strike when actuated by an external control signal.

17. The ballistic security barrier system as claimed in claim 16 wherein the external control signal is a keypad.

18. The ballistic security barrier system as claimed in claim 16 wherein the controller is powered by AC mains power.

* * * * *